US009997884B1

(12) United States Patent
Matsumoto

(10) Patent No.: US 9,997,884 B1
(45) Date of Patent: Jun. 12, 2018

(54) CONNECTOR

(71) Applicant: Japan Aviation Electronics Industry, Limited, Tokyo (JP)

(72) Inventor: Masakazu Matsumoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days. days.

(21) Appl. No.: 15/708,335

(22) Filed: Sep. 19, 2017

(30) Foreign Application Priority Data

Nov. 30, 2016 (JP) ..... 2016-232796

(51) Int. Cl.

| | |
|---|---|
| ***H01R 9/05*** | (2006.01) |
| ***H01R 43/02*** | (2006.01) |
| ***H01R 24/38*** | (2011.01) |
| ***H01R 13/508*** | (2006.01) |
| ***H01R 13/6592*** | (2011.01) |
| ***H01R 13/504*** | (2006.01) |

(52) U.S. Cl.
CPC ..... *H01R 43/0263* (2013.01); *H01R 13/504* (2013.01); *H01R 13/508* (2013.01); *H01R 13/6592* (2013.01); *H01R 24/38* (2013.01)

(58) Field of Classification Search
CPC ..... H01R 13/6658; H01R 43/0263; H01R 13/504; H01R 9/0521; H01R 9/0518; H01R 13/6592; H01R 24/38; H01R 13/508
USPC ..... 439/578
See application file for complete search history.

(56) References Cited

U.S. PATENT DOCUMENTS

| | | | | |
|---|---|---|---|---|
| 4,898,545 | A * | 2/1990 | Endo | H01R 9/0518 439/578 |
| 4,974,257 | A * | 11/1990 | Ibanez | H04M 17/026 379/143 |
| 5,567,115 | A * | 10/1996 | Carbone | F16M 11/40 362/198 |
| 2004/0266258 | A1* | 12/2004 | Stirling | H01R 9/0521 439/578 |
| 2011/0248801 | A1* | 10/2011 | Blake | H01R 13/6658 333/24 R |

FOREIGN PATENT DOCUMENTS

JP 2004-186057 A 7/2004

* cited by examiner

*Primary Examiner* — Jean Duverne
(74) *Attorney, Agent, or Firm* — Muncy, Geissler, Olds & Lowe, P.C.

(57) ABSTRACT

A connector includes an inner sleeve through which a central conductor and an insulator of a coaxial cable are passed, and an outer sleeve through which the central conductor, the insulator and a shield member of the coaxial cable are passed, the inner sleeve including a rotatable cylindrical member and having a cutout window opened by a predetermined angle range in a circumferential direction, a front end and a rear end of the cutout window in a direction along the central conductor coinciding with a front end of the central conductor and a front end of the insulator, respectively, the predetermined angle range of the cutout window being smaller than 180°, a straight line between both ends in the circumferential direction of the cutout window passing outside the central conductor.

11 Claims, 7 Drawing Sheets

CONNECTOR

BACKGROUND OF THE INVENTION

The present invention relates to a connector, in particular, to a connector that is attached to an end portion of a coaxial cable.

A connector for connection with a coaxial cable has been conventionally used, and JP 2004-186057 A, for example, discloses a connector as illustrated in FIG. 17. The connector includes a connector body 1 and a cable connecting portion cover 2, and the connector body 1 is configured such that a central contact 5 is held inside an outer conductor shell 3 via a holder 4 made of an insulating material. Meanwhile, a coaxial cable 6 is configured such that an insulator 8 covers an outer periphery of a central conductor 7 while an outer conductor 9 and a casing cover an outer periphery of the insulator 8.

A cylindrical outer conductor connecting portion 3A provided in the outer conductor shell 3 is inserted between the insulator 8 and the outer conductor 9 of the coaxial cable 6 so as to be electrically connected to the outer conductor 9, and the central conductor 7 of the coaxial cable 6 is soldered to the central contact 5 through a solder window 3B formed in the outer conductor shell 3, followed by attachment of the cable connecting portion cover 2 to the connector body 1.

The connector disclosed in JP 2004-186057 A, however, requires terminal processing to remove a portion of the insulator 8 at the front end of the coaxial cable 6 such that a predetermined length of the central conductor 7 is exposed before the outer conductor shell 3 is connected to the front end of the coaxial cable 6, and requires a dedicated terminal processing machine, for example, since the insulator 8 and the central conductor 7 do not provide a guide for a cutting position. Accordingly, there is a problem that it is difficult to attach the coaxial cable 6 to the connector at a site where connection of the coaxial cable 6 is carried out.

In addition, while the coaxial cable 6 has a rotationally symmetric configuration about the central axis, the elongated coaxial cable 6 typically has a curl. Accordingly, when the outer conductor shell 3 is attached to the front end of the coaxial cable 6, the solder window 3B of the outer conductor shell 3 does not always face in a direction allowing easy soldering work. Moreover, since the outer conductor connecting portion 3A of the outer conductor shell 3 is inserted between the insulator 8 and the outer conductor 9 of the coaxial cable 6 and is electrically connected to the outer conductor 9, it is difficult for the outer conductor shell 3 attached to the front end of the coaxial cable 6 to be rotated with respect to the coaxial cable 6. Accordingly, the soldering work to solder the central contact 5 to the central conductor 7 of the coaxial cable 6 through the solder window 3B of the outer conductor shell 3 may be difficult.

SUMMARY OF THE INVENTION

The present invention has been made in order to solve the problem described above, and an object of the present invention is to provide a connector capable of easy attachment to the front end of a coaxial cable even at a site where connection of the coaxial cable is carried out.

A connector according to the present invention comprises:

an inner sleeve through which a central conductor and an insulator of a coaxial cable are passed; and an outer sleeve through which the central conductor, the insulator and a shield member of the coaxial cable are passed, wherein the inner sleeve includes a cylindrical member that is attached to a front end side of the inner sleeve in a rotatable manner around the central conductor of the coaxial cable, and that has a cutout window opened by a predetermined angle range in a circumferential direction, wherein a front end of the cutout window of the cylindrical member in a direction along the central conductor of the coaxial cable coincides with a front end of the central conductor of the coaxial cable, wherein a rear end of the cutout window of the cylindrical member in the direction along the central conductor of the coaxial cable coincides with a front end of the insulator of the coaxial cable, and wherein the predetermined angle range of the cutout window of the cylindrical member as viewed from the direction along the central conductor of the coaxial cable is smaller than 180°, and a straight line connecting both ends in the circumferential direction of the cutout window of the cylindrical member passes outside the central conductor of the coaxial cable.

DETAILED DESCRIPTION OF THE INVENTION

Embodiments of the present invention are described below based on the appended drawings.

Embodiment 1

Figure 1:
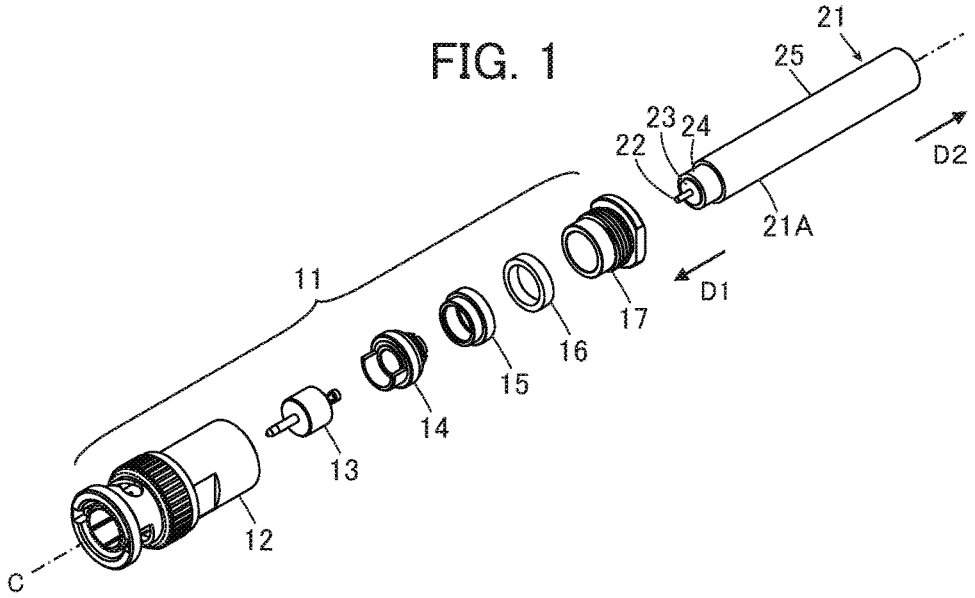
FIG. 1 is an exploded view of a connector according to Embodiment 1 of the present invention.

FIG. 1 is an exploded view showing a connector 11 according to Embodiment 1. The connector 11 is a plug to be attached to a front end 21A of a coaxial cable 21 and has a structure in which a central contact assembly 13, an inner sleeve 14, an outer sleeve 15, a gasket 16 and a clamp nut 17 are sequentially incorporated to a connector body 12 along a central axis C.

The coaxial cable 21 includes a central conductor 22, an insulator 23 that covers an outer periphery of the central conductor 22, a shield member 24 that covers an outer periphery of the insulator 23 and a casing 25 that covers an outer periphery of the shield member 24.

For convenience, a direction along the coaxial cable 21 toward the front end 21A of the coaxial cable 21 is called "first direction D1," whereas a direction opposite from the first direction D1 is called "second direction D2."

Figure 2:
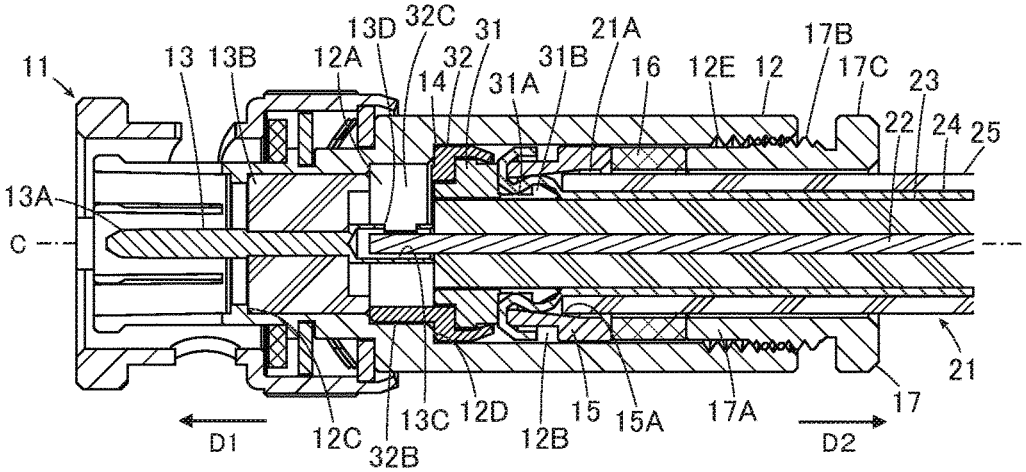
FIG. 2 is a cross-sectional view showing the connector according to Embodiment 1 as being attached to a front end of a coaxial cable.

FIG. 2 illustrates the connector 11 as being attached to the front end 21A of the coaxial cable 21.

As illustrated in FIG. 2, the connector body 12 is a tubular member formed of a conductive material such as metal, and inside the connector body 12, a central contact accommodation portion 12A is formed on the first direction D1 side while a coaxial cable accommodation portion 12B having a diameter larger than that of the central contact accommodation portion 12A is formed on the second direction D2 side.

In addition, an annular central contact holder abutment surface 12C facing in the second direction D2 is formed on an inner peripheral surface of the connector body 12 at an intermediate portion of the central contact accommodation portion 12A in the length direction along the central axis C so as to project toward the central axis C, and an annular inner sleeve abutment surface 12D facing in the second direction D2 is formed at a boundary between the central contact accommodation portion 12A and the coaxial cable accommodation portion 12B. In addition, at the end in the second direction D2 of the connector body 12, a female screw portion 12E is formed on the inner peripheral surface of the connector body 12.

The central contact assembly 13 includes a central contact 13A formed of a conductive material such as metal and extending linearly along the central axis C, and a central contact holder 13B in a cylindrical shape formed of an insulating material and for holding the central contact 13A. The central contact 13A penetrates through a through-hole formed in the central contact holder 13B along the central axis C, with an end portion in the first direction D1 and the other end portion in the second direction D2 of the central contact 13A each protruding from the central contact holder 13B.

At the end portion in the second direction D2 of the central contact 13A, a central conductor accommodation hole 13C extending along the central axis C and opening in the second direction D2 is formed, and an opening portion 13D communicating with the central conductor accommodation hole 13C and opening in a direction perpendicular to the central axis C is formed.

The central contact assembly 13 is accommodated in the central contact accommodation portion 12A of the connector body 12, with a circumferential portion of the central contact holder 13B on the first direction D1 side being in contact with the annular central contact holder abutment surface 12C of the connector body 12. An end portion in the first direction D1 of the central conductor 22 of the coaxial cable 21 is accommodated in the central conductor accommodation hole 13C of the central contact 13A and is soldered through the opening portion 13D, whereby the central contact 13A is connected to the central conductor 22 of the coaxial cable 21.

The inner sleeve 14 is consisted of an inner sleeve body 31 and a cylindrical member 32 attached to the inner sleeve body 31, and the inner sleeve body 31 and the cylindrical member 32 are each formed of a conductive material such as metal. The inner sleeve body 31 includes four cantilever spring portions 31A that are arranged at equal intervals in a circumferential direction and that each extend in the second direction D2 along the central axis C. Each of the spring portions 31A is provided with a projection portion 31B projecting outward in a radial direction.

The inner sleeve body 31 of the inner sleeve 14 has an inside diameter slightly larger than an outside diameter of the insulator 23 of the coaxial cable 21 and is accommodated in the coaxial cable accommodation portion 12B of the connector body 12 in such a manner that a surface, facing in the first direction D1, of the cylindrical member 32 comes into contact with the inner sleeve abutment surface 12D of the connector body 12, with the central conductor 22 and the insulator 23 of the coaxial cable 21 passing through the inner sleeve body 31 and the four projection portions 31B being inserted between the insulator 23 and the shield member 24 of the coaxial cable 21.

The outer sleeve 15 is an annular member formed of a conductive material such as metal and has an inner peripheral surface 15A in a truncated conical surface shape tapered toward the first direction D1. An inside diameter of the inner peripheral surface 15A at one end portion in the second direction D2 is designed to be larger than an outside diameter of the casing 25 of the coaxial cable 21, while an inside diameter of the inner peripheral surface 15A at the other end portion in the first direction D1 is designed to be smaller than the inside diameter at the one end portion in the second direction D2 and larger than the inside diameter of the inner sleeve body 31 of the inner sleeve 14.

The outer sleeve 15 is accommodated in the coaxial cable accommodation portion 12B of the connector body 12, with the central conductor 22, the insulator 23 and the shield member 24 of the coaxial cable 21 passing through the outer sleeve 15 and the four projection portions 31B of the inner sleeve body 31 of the inner sleeve 14 being covered by the inner peripheral surface 15A. The shield member 24 of the coaxial cable 21 is held between the four projection portions 31B of the inner sleeve body 31 and the inner peripheral surface 15A of the outer sleeve 15.

The gasket 16 is an annular member formed of an elastic material and is configured to be elastically deformable under compression. The gasket 16 is disposed so as to surround the outer periphery of the casing 25 of the coaxial cable 21.

The clamp nut 17 is a tubular member formed of a conductive material such as metal and has a cylindrical portion 17A that is inserted into the coaxial cable accommodation portion 12B of the connector body 12, and a male screw portion 17B corresponding to the female screw portion 12E of the connector body 12 is formed on an outer periphery of the cylindrical portion 17A. In addition, a flange 17C extending outward in the radial direction is provided at an end portion in the second direction D2 of the cylindrical portion 17A of the clamp nut 17.

The clamp nut 17 has an inside diameter slightly larger than the outside diameter of the casing 25 of the coaxial cable 21. The cylindrical portion 17A is inserted in the coaxial cable accommodation portion 12B of the connector body 12 with the coaxial cable 21 passing through the clamp nut 17, while the male screw portion 17B is screwed to the female screw portion 12E of the connector body 12, whereby the clamp nut 17 is held by the connector body 12.

When the clamp nut 17 is rotated around the central axis C by means of the flange 17C so that the clamp nut 17 advances in the first direction D1, the outer sleeve 15 is pressed in the first direction D1 via the gasket 16, and the shield member 24 of the coaxial cable 21 held between the four projection portions 31B of the inner sleeve 14 and the inner peripheral surface 15A of the outer sleeve 15 is sandwiched between a surface facing in the second direction D2 of the inner sleeve body 31 of the inner sleeve 14 and an end surface facing in the first direction D1 of the outer sleeve 15, whereby the coaxial cable 21 is held by the connector 11.

At this time, the central conductor 22 of the coaxial cable 21 is electrically connected to the central contact 13A of the central contact assembly 13, and the shield member 24 of the coaxial cable 21 is electrically connected to the connector body 12 via the inner sleeve 14.

Figure 3:
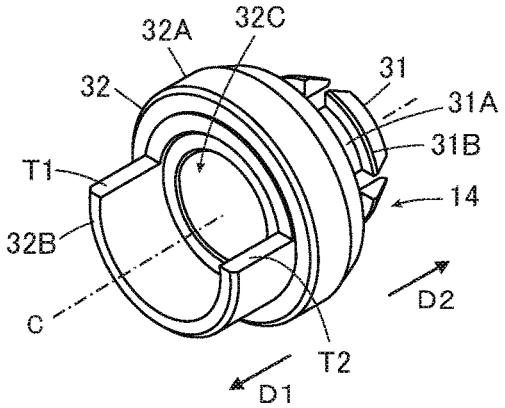
FIG. 3 is a perspective view showing an inner sleeve used in the connector according to Embodiment 1 when viewed obliquely from the front.
Figure 4:
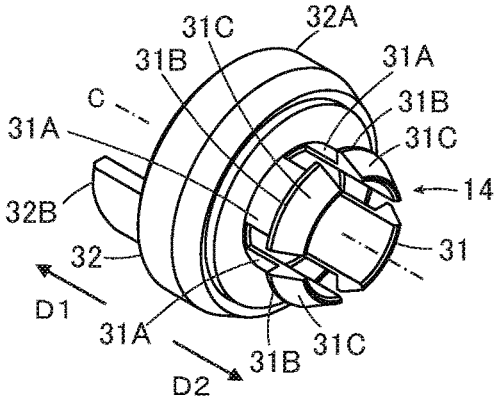
FIG. 4 is a perspective view showing the inner sleeve used in the connector according to Embodiment 1 when viewed obliquely from the rear.
Figure 5:
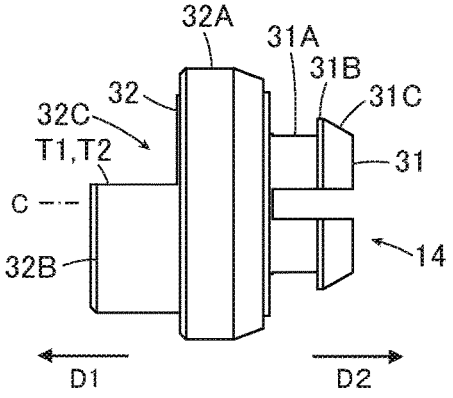
FIG. 5 is a side view showing the inner sleeve used in the connector according to Embodiment 1.

Here, the inner sleeve 14 is described in detail. As illustrated in FIGS. 3 to 5, the inner sleeve 14 is consisted of the inner sleeve body 31 and the cylindrical member 32, and the cylindrical member 32 is attached to the inner sleeve body 31 in a rotatable manner around the central axis C.

The four projection portions 31B independently formed on the four spring portions 31A of the inner sleeve body 31 are disposed at equal intervals on a predetermined circumference whose center is the central axis C and are each configured to be elastically displaceable in the radial direction due to the corresponding spring portion 31A. Each of the projection portions 31B has a slanted surface 31C that faces outward in the radial direction and that is slanted such that an amount of projection of the projection portion 31B in the radial direction decreases toward the second direction D2.

The cylindrical member 32 is disposed on the front end side, i.e., on the first direction D1 side, of the inner sleeve 14 and is consisted of an annular portion 32A rotatably attached to the outer periphery of the inner sleeve body 31 and an arc portion 32B projecting from the annular portion 32A in the first direction D1 along the central axis C. The arc portion 32B is in a so-called gutter shape that is a shape obtained by removing a part along a circumferential direction from a cylinder with the center at the central axis C, and the arc portion 32B has a cutout window 32C that is open by a predetermined angle range A between opposite circumferential end portions T1 and T2.

Figure 6:
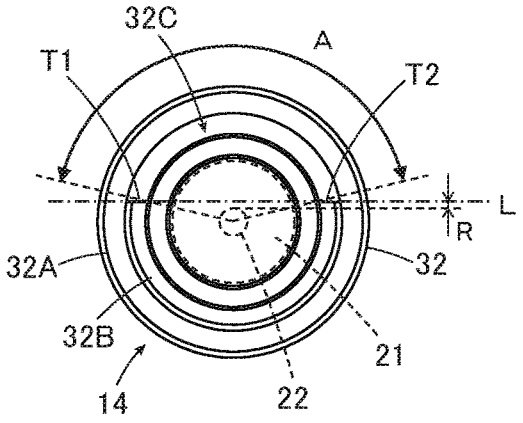
FIG. 6 is a front view showing the inner sleeve used in the connector according to Embodiment 1.

As illustrated in FIG. 6, the cylindrical member 32 is configured such that, when the arc portion 32B of the cylindrical member 32 is viewed from the direction along the central axis C, the predetermined angle range A by which the cutout window 32C is open is smaller than 180°, a straight line L between the opposite circumferential end portions T1 and T2 of the cutout window 32C does not intersect the central conductor 22 of the coaxial cable 21 that is inserted through the inner sleeve 14, and the straight line L passes outside the outer periphery of the central conductor 22 away in the radial direction by a distance R. The distance R may be set to a value such as 0.1 to 0.2 mm.

Figure 7:
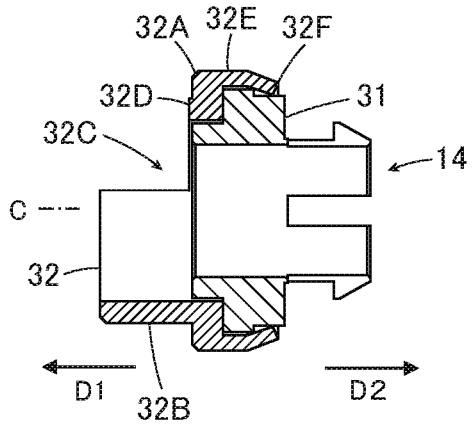
FIG. 7 is a cross-sectional view showing the inner sleeve used in the connector according to Embodiment 1.

As illustrated in FIG. 7, the annular portion 32A of the cylindrical member 32 has an annular plate portion 32D provided with an opening on the central axis C and a cylindrical portion 32E projecting from the circumference of the annular plate portion 32D in the second direction D2. Inside the cylindrical portion 32E, the inner sleeve body 31 is accommodated, and the end portion in the second direction D2 of the cylindrical portion 32E has a smaller inside diameter than the maximum diameter of the inner sleeve body 31, whereby the cylindrical member 32 is rotatably attached to the inner sleeve body 31 and does not fall off the inner sleeve body 31.

Figure 8:
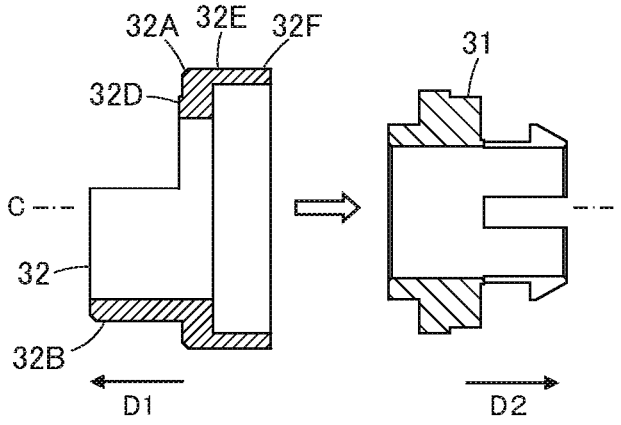
FIG. 8 is a cross-sectional view showing an inner sleeve body and a cylindrical member that constitute the inner sleeve used in the connector according to Embodiment 1.

As illustrated in FIG. 8, for example, the cylindrical member 32 is formed such that the whole cylindrical portion 32E has an inside diameter slightly larger than the maximum diameter of the inner sleeve body 31, and with the cylindrical portion 32E being placed over the outer periphery of the inner sleeve body 31, an end portion 32F in the second direction D2 of the cylindrical portion 32E is crimped and deformed such that the inside diameter of the end portion 32F in the second direction D2 becomes smaller than the maximum diameter of the inner sleeve body 31, whereby the inner sleeve 14 as above can be produced.

The inner sleeve 14 can be also produced not through the crimping process but through the fitting process in which the cylindrical portion 32E whose end portion 32F in the second direction D2 having an inner diameter designed to be slightly smaller than the maximum diameter of the inner sleeve body 31 is fitted to the outer periphery of the inner sleeve body 31 with the aid of elastic deformation. In this case, in place of the cylindrical portion 32E, a plurality of spring portions projecting from the circumference of the annular plate portion 32D in the second direction D2 may be formed, and the cylindrical member 32 may be fitted to the outer periphery of the inner sleeve body 31 while those spring portions are elastically deformed.

Figure 9A:
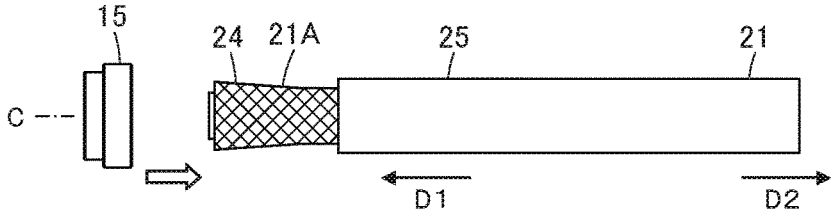
FIGS. 9A to 9E are side views showing steps of attaching the inner sleeve and an outer sleeve to the front end of the coaxial cable in processing order.
Figure 9B:
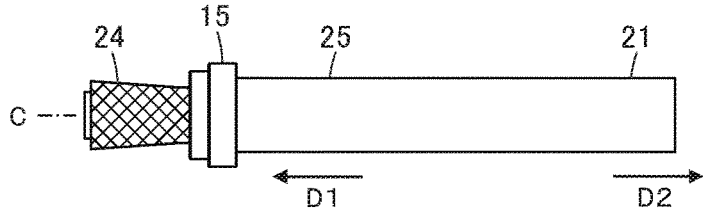

For attaching the connector 11 to the front end 21A of the coaxial cable 21, first, as illustrated in FIG. 9A, a predetermined length of a portion of the casing 25 along the central axis C at the front end 21A of the coaxial cable 21 is removed to have the shield member 24 exposed. In addition, the outer sleeve 15 is fitted to the outer periphery of the front end 21A of the coaxial cable 21 where the shield member 24 is exposed, and, as illustrated in FIG. 9B, the outer sleeve 15 is disposed so as to overlap the end portion in the first direction D1 of the casing 25.

Figure 9C:
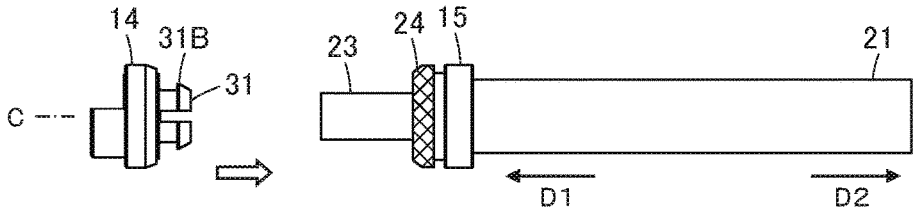

Next, as illustrated in FIG. 9C, the four projection portions 31B of the inner sleeve 14 are inserted between the insulator 23 and the shield member 24 of the coaxial cable 21 along the central axis C, and, in this state, the inner sleeve 14 is pressed in the second direction D2.

Figure 10:
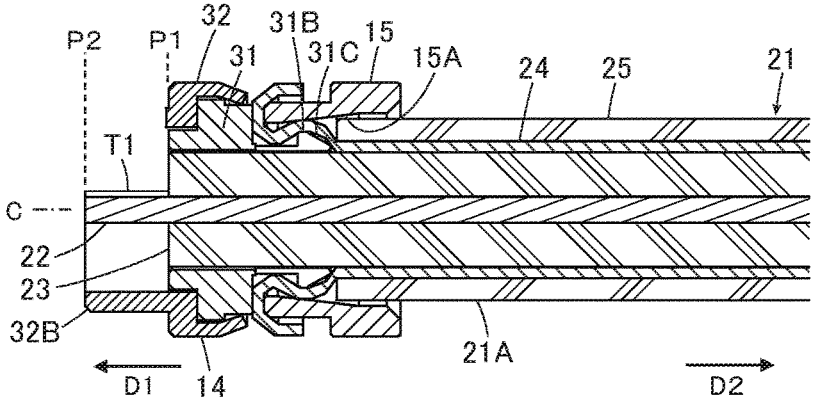
FIG. 10 is a cross-sectional view showing a front end portion of the coaxial cable to which the inner sleeve and the outer sleeve are attached.

In this process, as illustrated in FIG. 10, the slanted surfaces 31C of the four projection portions 31B of the inner sleeve 14 each come into contact with the edge portion in the first direction D1 of the inner peripheral surface 15A of the outer sleeve 15 via the shield member 24 of the coaxial cable 21, and at least one of the four spring portions 31A elastically deforms toward the central axis C, whereby the four projection portions 31B pass over the edge portion in the first direction D1 of the inner peripheral surface 15A of the outer sleeve 15, and the deformed spring portions 31A return to their original state when the four projection portions 31B come inside the inner peripheral surface 15A of the outer sleeve 15. That is, the inner peripheral surface 15A of the outer sleeve 15 covers the four projection portions 31B of the inner sleeve 14.

Figure 9D:
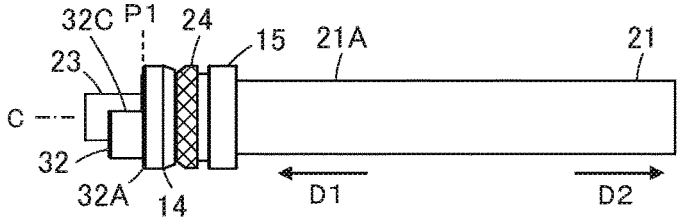

The inner sleeve 14 is attached to the front end 21A of the coaxial cable 21 in this manner as illustrated in FIG. 9D, and the insulator 23 of the coaxial cable 21 is then cut with a cutting tool or the like, using a rear end position (end position in the second direction D2) P1 of the cutout window 32C of the cylindrical member 32 of the inner sleeve 14, i.e., a surface facing in the first direction D1 of the annular portion 32A of the cylindrical member 32 as a guide. At this time, since the predetermined angle range A by which the cutout window 32C is open is smaller than 180°, and the straight line L between the opposite circumferential end portions T1 and T2 of the cutout window 32C passes outside the outer periphery of the central conductor 22 of the coaxial cable 21 away in the radial direction by the distance R so that the straight line L does not intersect the central conductor 22 as illustrated in FIG. 6, the cutting tool abuts the opposite circumferential end portions T1 and T2 of the cutout window 32C and stops, thereby being prevented from damaging the central conductor 22 of the coaxial cable 21.

Since the cylindrical member 32 of the inner sleeve 14 is attached to the inner sleeve body 31 in a rotatable manner around the central axis C, when the insulator 23 of the coaxial cable 21 is cut with a cutting tool while the cylindrical member 32 is rotated around the central axis C, the entire circumference of the insulator 23 around the central axis C is cut to the position outside the outer periphery of the central conductor 22 away by the distance R. Accordingly, a portion of the insulator 23 from the rear end position P1 of the cutout window 32C toward the first direction D1 can be readily stripped off.

Figure 9E:
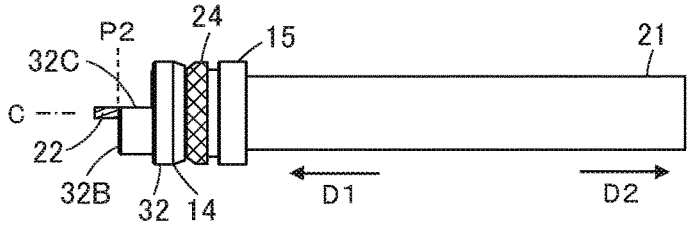

Removal of the portion of the insulator 23 on the first direction D1 side allows the central conductor 22 projecting in the first direction D1 to be exposed as illustrated in FIG. 9E, and, subsequently, the central conductor 22 of the coaxial cable 21 is cut with a cutting tool, having a front end position (end position in the first direction D1) P2 of the cutout window 32C of the cylindrical member 32, i.e., a surface facing in the first direction D1 of the arc portion 32B of the cylindrical member 32 as a guide.

Accordingly, as illustrated in FIG. 10, the rear end position P1 of the cutout window 32C of the cylindrical member coincides with the front end (end in the first direction D1) of the insulator 23 of the coaxial cable 21, while the front end position P2 of the cutout window 32C of the cylindrical member 32 coincides with the front end (end in the first direction D1) of the central conductor 22 of the coaxial cable 21.

Figure 11:
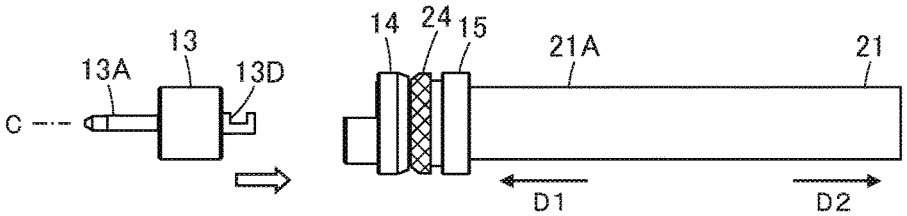
FIG. 11 is a side view showing how a central contact assembly is attached to the front end of the coaxial cable.

Next, as illustrated in FIG. 11, the central contact assembly 13 is brought along the central axis C to the vicinity of the front end 21A of the coaxial cable 21 to which the inner sleeve 14 and the outer sleeve 15 are attached, and the central conductor 22 of the coaxial cable 21 projecting in the first direction D1 is inserted to the central conductor accommodation hole 13C of the central contact 13A of the central contact assembly 13. In this process, the rotation position of the central contact assembly 13 around the central axis C is adjusted such that the opening portion 13D of the central contact 13A faces in a direction allowing easy soldering, and the central conductor 22 of the coaxial cable 21 is inserted to the central conductor accommodation hole 13C of the central contact 13A.

Figure 12:
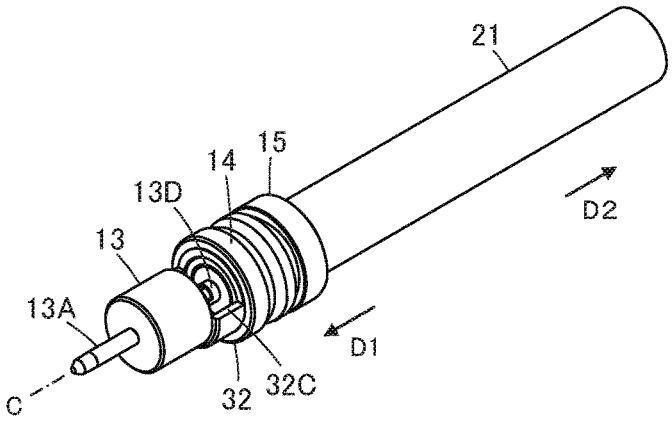
FIG. 12 is a perspective view showing the front end portion of the coaxial cable when a central contact is soldered to a central conductor of the coaxial cable.
Figure 13:
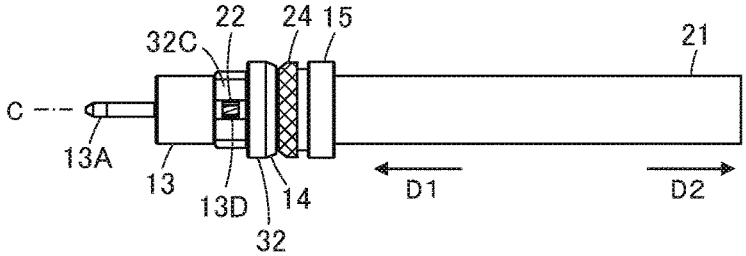
FIG. 13 is a plan view showing the front end portion of the coaxial cable when the central contact is soldered to the central conductor of the coaxial cable.
Figure 14:
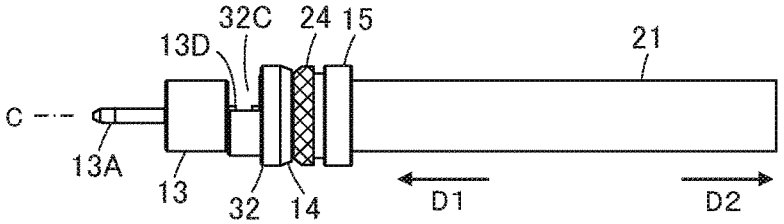
FIG. 14 is a side view showing the front end portion of the coaxial cable when the central contact is soldered to the central conductor of the coaxial cable.

Since the cylindrical member 32 of the inner sleeve 14 is rotatable with respect to the inner sleeve body 31 around the central axis C, by means of rotation of the cylindrical member 32 around the central axis C, as illustrated in FIGS. 12 to 14, the cutout window 32C of the cylindrical member 32 is turned to face in the same direction as the direction the opening portion 13D of the central contact 13A faces, whereby the opening portion 13D of the central contact 13A can be exposed through the cutout window 32C of the cylindrical member 32.

In this state, the central contact 13A is soldered to the central conductor 22 of the coaxial cable 21 through the opening portion 13D of the central contact 13A. During the soldering process, since the opening portion 13D of the central contact 13A faces in a direction allowing easy soldering while the cutout window 32C of the cylindrical member 32 is turned to face in the same direction as the direction the opening portion 13D of the central contact 13A faces, even if the coaxial cable 21 is curled, the soldering process can be readily and reliably performed at the opening portion 13D of the central contact 13A through the cutout window 32C of the cylindrical member 32.

After the inner sleeve 14 is attached to the front end 21A of the coaxial cable 21, as illustrated in FIG. 10, the shield member 24 of the coaxial cable 21 is held between the four projection portions 31B of the inner sleeve 14 and the inner peripheral surface 15A of the outer sleeve 15. In addition, since the inner peripheral surface 15A of the outer sleeve 15 is in a truncated conical surface shape tapered toward the first direction D1, the projection portions 31B of the inner sleeve 14 each receive, from the inner peripheral surface 15A of the outer sleeve 15, a vertical drag containing a force component acting toward the second direction D2. Therefore, the inner sleeve 14 whose four projection portions 31B are inserted between the insulator 23 and the shield member 24 of the coaxial cable 21 is prevented from coming off from the coaxial cable 21 in the first direction D1. Accordingly, the process of cutting the insulator 23 and the central conductor 22 of the coaxial cable 21 as well as the process of soldering the central contact 13A to the central conductor 22 of the coaxial cable 21 can be efficiently performed.

Even in the case where the shield member 24 is made of an elastic braid so that the coaxial cable 21 can withstand repetition of bending motions for use in a robot or the like, the connector 11 can be securely attached to the coaxial cable 21.

When the central contact 13A of the central contact assembly 13 is connected to the central conductor 22 of the coaxial cable 21 in this manner, as illustrated in FIG. 2, the central contact assembly 13 is inserted into the central contact accommodation portion 12A of the connector body 12 from the end portion in the second direction D2 of the connector body 12, and the front end 21A of the coaxial cable 21 is accommodated in the coaxial cable accommodation portion 12B of the connector body 12 such that the surface facing in the first direction D1 of the cylindrical member 32 of the inner sleeve 14 comes into contact with the inner sleeve abutment surface 12D of the connector body 12. At this time, the central contact holder 13B of the central contact assembly 13 is sandwiched and held between the annular central contact holder abutment surface 12C of the connector body 12 and the end portion in the first direction D1 of the arc portion 32B of the inner sleeve 14.

Moreover, the gasket 16 and the cylindrical portion 17A of the clamp nut 17 through which the coaxial cable 21 is passed are inserted in the coaxial cable accommodation portion 12B of the connector body 12, and the clamp nut 17 is rotated around the central axis C to have the male screw portion 17B of the clamp nut 17 screwed to the female screw portion 12E of the connector body 12, whereby attachment of the connector 11 to the coaxial cable 21 can be completed.

The central conductor 22 of the coaxial cable 21 is soldered and electrically connected to the central contact 13A, and the shield member 24 of the coaxial cable 21 is held between the inner sleeve body 31 of the inner sleeve 14 and the outer sleeve 15 and is electrically connected to the connector body 12 via the inner sleeve body 31 and the cylindrical member 32 of the inner sleeve 14 and the inner sleeve abutment surface 12D of the connector body 12.

If the clamp nut 17 is screwed into the connector body 12 tightly, the gasket 16 disposed between the outer sleeve 15 and the clamp nut 17 is compressed in the first direction D1 and elastically deforms, thereby sealing between the inner peripheral surface of the coaxial cable accommodation portion 12B of the connector body 12 and the outer peripheral surface of the casing 25 of the coaxial cable 21. In this manner, the waterproof properties between the coaxial cable 21 and the connector 11 are ensured while the clamp nut 17 is prevented from unfastening from the connector body 12.

Meanwhile, if waterproof properties and prevention of unfastening of the clamp nut 17 are not required, the gasket 16 may be omitted, and the connector may be configured such that the clamp nut 17 directly contacts the outer sleeve 15.

In the connector 11 as configured above, since the inner sleeve 14 has the cylindrical member 32 that is rotatable around the central axis C while the cylindrical member 32 is provided with the cutout window 32C that is open by the predetermined angle range A in the circumferential direction, the process of cutting the insulator 23 and the central conductor 22 of the coaxial cable 21 as well as the process of soldering the central contact 13A to the central conductor 22 of the coaxial cable 21 can be efficiently performed at the site where connection of the coaxial cable 21 is carried out, and the connector 11 can be readily attached to the front end 21A of the coaxial cable 21.

The cylindrical member 32 of the inner sleeve 14 is formed of a conductive material such as metal in Embodiment 1 described above. Meanwhile, if the connector is configured such that the shield member 24 of the coaxial cable 21 is electrically connected to the connector body 12 without having the cylindrical member 32 therebetween, the cylindrical member 32 may be formed of an insulating material such as an insulating resin.

While the four projection portions 31B of the inner sleeve 14 are independently formed on the four spring portions 31A so as to be elastically displaceable in the radial direction in Embodiment 1 as described above, this is not the sole case. As long as at least one of the projection portions 31B is formed at the corresponding spring portion 31A and is elastically displaceable in the radial direction, when the inner sleeve 14 is pressed in the second direction D2 with the four projection portions 31B being inserted between the insulator 23 and the shield member 24 of the coaxial cable 21, the four projection portions 31B of the inner sleeve 14 can pass over the edge portion in the first direction D1 of the inner peripheral surface 15A of the outer sleeve 15 to be located inside the inner peripheral surface 15A of the outer sleeve 15.

Moreover, the number of the projection portions 31B of the inner sleeve 14 is not particularly limited to four; as long as the inner sleeve 14 includes two or more projection portions 31B, the inner sleeve 14 and the outer sleeve 15 can be held with respect to the coaxial cable 21 with the projection portions 31B and the inner peripheral surface 15A of the outer sleeve 15 sandwiching the shield member 24 of the coaxial cable 21 therebetween, and, accordingly, the connector 11 that does not readily fall off during the attachment process and that can be securely attached to the front end 21A of the coaxial cable 21 can be realized.

Embodiment 2

In the connector 11 according to Embodiment 1, the present invention is applied to a plug that is to be attached to the front end 21A of the coaxial cable 21. Meanwhile, the present invention can be also applied to a so-called jack (receptacle) that is fitted to a plug.

Figure 15:
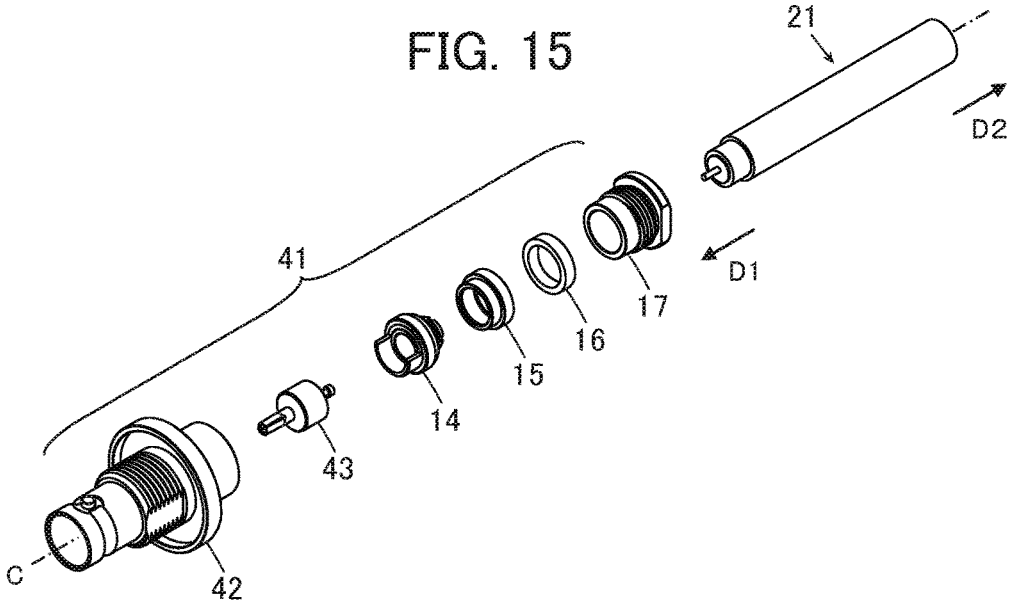
FIG. 15 is an exploded view of a connector according to Embodiment 2.

FIG. 15 illustrates an exploded view of a connector 41 according to Embodiment 2. The connector 41 is a jack to be attached to the front end 21A of the coaxial cable 21 and has a structure in which a central contact assembly 43, the inner sleeve 14, the outer sleeve 15, the gasket 16 and the clamp nut 17 are sequentially incorporated to a connector body 42 along a central axis C. In other words, the connector body 12 and the central contact assembly 13 in the connector 11 according to Embodiment 1 as illustrated in FIG. 1 are replaced by the contact body 42 and the central contact assembly 43 while the other constituent components of the connector 11 according to Embodiment 1 remain the same.

Figure 16:
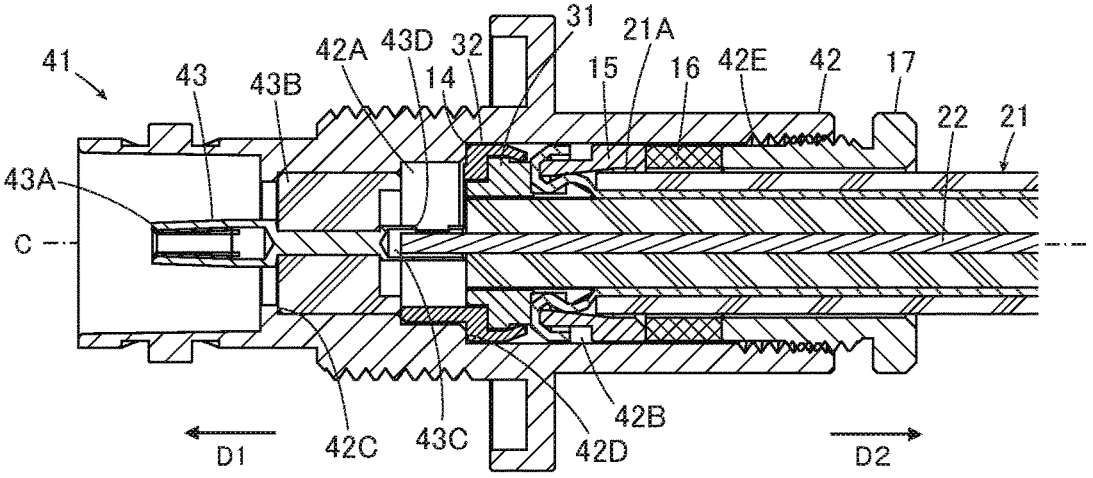
FIG. 16 is a cross-sectional view showing the connector according to Embodiment 2 as being attached to a front end of a coaxial cable.
Figure 17:
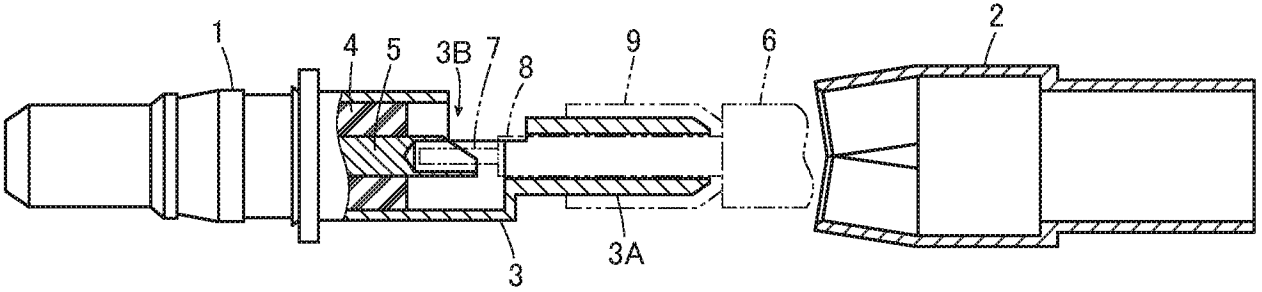
FIG. 17 PRIOR ART
FIG. 17 is a cross-sectional view showing a conventional connector.

As illustrated in FIG. 16, the connector body 42 is a tubular member formed of a conductive material such as metal similarly to the connector body 12 of the connector 11 according to Embodiment 1, and inside the connector body 42, a central contact accommodation portion 42A and a coaxial cable accommodation portion 42B are formed.

In addition, an annular central contact holder abutment surface 42C facing in the second direction D2 is formed at an intermediate portion of the central contact accommodation portion 42A in the length direction along the central axis C, and an annular inner sleeve abutment surface 42D facing in the second direction D2 is formed at a boundary between the central contact accommodation portion 42A and the coaxial cable accommodation portion 42B. Furthermore, a female screw portion 42E is formed on an inner peripheral surface of an end portion in the second direction D2 of the connector body 42.

Similarly to the central contact assembly 13 of the connector 11 according to Embodiment 1, the central contact assembly 43 includes a central contact 43A formed of a conductive material such as metal and a central contact holder 43B formed of an insulating material, and at an end portion in the second direction D2 of the central contact 43A, a central conductor accommodation hole 43C extending along the central axis C and opening toward the second direction D2 is formed while an opening portion 43D communicating with the central conductor accommodation hole 43C is formed.

Meanwhile, whereas the end portion of the central contact 13A projecting in the first direction D1 from the central contact holder 13B of the connector 11 according to Embodiment 1 has a pin shape, an end portion of the central contact 43A projecting in the first direction D1 from the central contact holder 43B of the connector 41 according to Embodiment 2 is in a socket shape so as to be able to accommodate the end portion of the pin-shaped central contact 13A of the plug.

In the case of the connector 41 according to Embodiment 2 configured as above, similarly to the connector 11 according to Embodiment 1, at a site where connection of coaxial cable 21 is carried out, the process of cutting the insulator 23 and the central conductor 22 of the coaxial cable 21 as well as the process of soldering the central contact 43A to the central conductor 22 of the coaxial cable 21 can be efficiently performed, and the connector 41 can be readily attached to the front end 21A of the coaxial cable 21.

What is claimed is:

1. A connector that is attached to a front end of a coaxial cable, the coaxial cable including a central conductor, an insulator covering an outer periphery of the central conductor and a shield member covering an outer periphery of the insulator, the connector comprising:

an inner sleeve through which the central conductor and the insulator of the coaxial cable are passed; and an outer sleeve through which the central conductor, the insulator and the shield member of the coaxial cable are passed, wherein the inner sleeve includes a cylindrical member that is attached to a front end side of the inner sleeve in a rotatable manner around the central conductor of the coaxial cable, and that has a cutout window opened by a predetermined angle range in a circumferential direction, wherein a front end of the cutout window of the cylindrical member in a direction along the central conductor of the coaxial cable coincides with a front end of the central conductor of the coaxial cable, wherein a rear end of the cutout window of the cylindrical member in the direction along the central conductor of the coaxial cable coincides with a front end of the insulator of the coaxial cable, and wherein the predetermined angle range of the cutout window of the cylindrical member as viewed from the direction along the central conductor of the coaxial cable is smaller than 180°, and a straight line connecting both ends in the circumferential direction of the cutout window of the cylindrical member passes outside the central conductor of the coaxial cable.

2. The connector according to claim 1, wherein the inner sleeve includes an inner sleeve body that is disposed at a rear end side of the inner sleeve, wherein the cylindrical member is rotatably attached to the inner sleeve body, wherein the inner sleeve body includes a plurality of projection portions that are arranged in a circumferential direction, project outward in a radial direction and are inserted between the insulator and the shield member of the coaxial cable, and at least one of the plurality of projection portions is elastically displaceable in the radial direction, wherein the outer sleeve includes an inner peripheral surface that covers the plurality of projection portions of the inner sleeve body and that tapers in a first direction directed toward the front end of the coaxial cable along the coaxial cable, and wherein the shield member of the coaxial cable is sandwiched between the plurality of projection portions of the inner sleeve body and the inner peripheral surface of the outer sleeve.

3. The connector according to claim 2, wherein each of the plurality of projection portions of the inner sleeve is elastically displaceable in the radial direction.

4. The connector according to claim 2, wherein the plurality of projection portions of the inner sleeve are disposed at equal intervals on a predetermined circumference around the central conductor of the coaxial cable.

5. The connector according to claim 2, wherein each of the plurality of projection portions of the inner sleeve has a slanted surface such that an amount of projection of the projection portion in the radial direction decreases toward a second direction opposite from the first direction.

6. The connector according to claim 2, wherein the inner sleeve body and the cylindrical member are formed of a conductive material, and wherein the shield member of the coaxial cable is electrically connected to the inner sleeve through contact with the inner sleeve body.

7. The connector according to claim 6, wherein the shield member of the coaxial cable is held by being sandwiched between a surface facing in a second direction opposite from the first direction of the inner sleeve body of the inner sleeve and an end surface facing in the first direction of the outer sleeve.

8. The connector according to claim 2, comprising:

a connector body in a tubular shape accommodating the inner sleeve and the outer sleeve and including an inner sleeve abutment surface which faces in a second direction opposite from the first direction and on which the inner sleeve abuts;

a central contact that is held in the connector body and electrically connected to the central conductor of the coaxial cable; and a clamp nut that is screwed to the connector body to thereby press the outer sleeve in the first direction.

9. The connector according to claim 8, comprising a central contact holder in a cylindrical shape formed of an insulating material and holding the central contact, wherein the connector body includes a central contact holder abutment surface which is disposed closer to a front end side than the inner sleeve abutment surface, which faces in the second direction, and on which the central contact holder abuts, and wherein the central contact holder is sandwiched between the central contact holder abutment surface of the connector body and the cylindrical member of the inner sleeve to be held in the connector body.

10. The connector according to claim 8, wherein the central contact includes a central conductor accommodation hole opening toward the second direction, and wherein the central conductor of the coaxial cable is soldered to the central contact while being inserted in the central conductor accommodation hole.

11. The connector according to claim 2, wherein the shield member of the coaxial cable is made of an elastic braid.

* * * * *